US008490311B2

(12) United States Patent
Hogue

(10) Patent No.: US 8,490,311 B2
(45) Date of Patent: Jul. 23, 2013

(54) FIREARM GRIP SLEEVE WITH RETENTION FEATURE

(75) Inventor: Patrick Leonard Hogue, Fayetteville, NC (US)

(73) Assignee: Hogue, Inc., Paso Robles, CA (US)

( * ) Notice: Subject to any disclaimer, the term of this patent is extended or adjusted under 35 U.S.C. 154(b) by 553 days.

(21) Appl. No.: 12/655,977

(22) Filed: Jan. 11, 2010

(65) Prior Publication Data

US 2011/0167698 A1 Jul. 14, 2011

(51) Int. Cl.
*F41C 23/10* (2006.01)

(52) U.S. Cl.
USPC ..... 42/71.01; 42/72

(58) Field of Classification Search
USPC ..... 42/71.01, 72, 74; 89/1.42; 16/421, 16/430
See application file for complete search history.

(56) References Cited

U.S. PATENT DOCUMENTS 3,410,017 A * 11/1968 Wilson ..... 43/22
4,043,066 A * 8/1977 Pachmayr et al. ..... 42/71.02
4,132,024 A * 1/1979 Pachmayr et al. ..... 42/71.02
4,729,271 A * 3/1988 Kenigson ..... 81/177.1
D351,448 S * 10/1994 Fisher ..... D22/108
D351,638 S * 10/1994 Scott et al. ..... D22/108
5,469,601 A * 11/1995 Jackson ..... 16/421
5,666,667 A * 9/1997 Hook, Jr. ..... 2/159
D393,194 S * 4/1998 Hogue et al. ..... D8/70
6,082,468 A * 7/2000 Pusateri et al. ..... 173/170
7,818,910 B2 * 10/2010 Young ..... 42/71.01
7,823,312 B2 * 11/2010 Faifer ..... 42/49.02
2005/0188587 A1 * 9/2005 Danas ..... 42/72
2006/0130386 A1 * 6/2006 Pikielny ..... 42/85
2006/0162222 A1 * 7/2006 Beretta ..... 42/72
2009/0313873 A1 * 12/2009 Roth ..... 42/72
2011/0185617 A1 * 8/2011 Brixius ..... 42/71.01

* cited by examiner

*Primary Examiner* — Bret Hayes
(74) *Attorney, Agent, or Firm* — Bennet K. Langlotz; Langlotz Patent & Trademark Works, Inc.

(57) ABSTRACT

A firearm grip sleeve with retention feature has a body including a central bore and a meeting element. The mating element is connected to a mating feature on the frame of a firearm. The mating element is connected to a mating feature on the frame of a firearm. The mating element prevents undesirable movement of the body with respect to the firearm while the mating feature is connected to the mating element. The mating element may prevent axial movement and upward longitudinal movement of the body. The firearm may include a removable back strap insert.

21 Claims, 9 Drawing Sheets

FIREARM GRIP SLEEVE WITH RETENTION FEATURE

FIELD OF THE INVENTION

The present invention relates to firearm grip assemblies for handguns, and more particularly to a device that enhances the functionality of the standard factory-supplied firearm grip while remaining in a fixed position with respect to the firearm grip.

BACKGROUND OF THE INVENTION

It is often desirable to utilize firearm grip assemblies composed of rubber or other relatively soft elastomers in conjunction with standard factory-supplied firearm grips for handguns. The use of a soft firearm grip sleeve assembly provides the user with a more secure grip. Such firearm grip assemblies often include ergonomic features such as finger ridges and palm swells to provide adequate security for holding the gun during recoil. The firearm grip assemblies may also provide a larger grip circumference than the standard factory-supply firearm grip to accommodate users with larger hands. Firearm grip assemblies may include rigid inserts for reinforcement of the elastomer material.

Three examples of firearm grip assemblies that enhance standard factory-supplied firearm grips for handguns are found in U.S. Pat. No. 1,049,739 (Leach, Jr.), U.S. Pat. No. 5,621,997 (Pearce), and D349,938 (Hogue et al.). The Leach, Jr. patent discloses an auxiliary grip made of soft rubber other elastic material that causes it to be self retaining in place on a revolver or pistol grip. The Pearce patent discloses a handgun grip enhancer unit for use with side panel grip type handguns. The unit is made from elastomer. The Hogue et al. patent discloses an ornamental design for a sleeve for a pistol grip.

However, there are a number of potential disadvantages with prior art patents and existing practiced prior art, at least for some applications. These issues include challenges associated with getting the firearm grip assembly onto and off of the standard factory-supplied firearm grip. In the case of the Pearce patent, the user must remove the side panel grip elements, position the wing members over the gun handle so that the Panhandle's bosses engage the holes in the wing members, and subsequently replace the side panel grip elements in order to install the handgun grip enhancer unit. In the case of the Hogue et al. patent, the user must stretch the sleeve over the standard factory-pistol grip and avoid tearing sleeve. The user may also be required to trim the sleeve in order to achieve proper fit, which must be performed carefully to avoid scratching the gun.

Existing firearm grip sleeves must be designed to fit very tightly and require considerable force to install because they exclusively rely on compression around the standard factory-firearm grip to retain them in position. One of the major problems is that existing firearm grip sleeves can still move and creep out of position if they are not adequately tight. Such movement can compromise accuracy by causing the user to grip the firearm in an atypical orientation. Such movement can also compromise safety by overriding gun functions such as grip safeties.

All of the above firearm grip assemblies have significant disadvantages in terms of safety and convenience, at least for certain applications and needs.

It is therefore an object of this invention to provide a firearm grip sleeve with retention feature that enhances the functionality of standard factory-supplied firearm grips while remaining in a fixed position with respect to the firearm grip.

SUMMARY OF THE INVENTION

The present invention provides an improved firearm grip sleeve with retention feature, and overcomes the above-mentioned disadvantages and drawbacks of the prior art. As such, the general purpose of the present invention, which will be described subsequently in greater detail, is to provide an improved firearm grip sleeve with retention feature that has all the advantages of the prior art mentioned above with the exception of a universal fit.

To attain this, the preferred embodiment of the present invention essentially comprises a body including a central bore and a mating element. The mating element is connected to a mating feature on the frame of a firearm. The mating element prevents undesirable movement of the body with respect to the firearm while the mating feature is connected to the mating element. The mating element may prevent axial movement and upward longitudinal movement of the body. The firearm may include a removable back strap insert. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
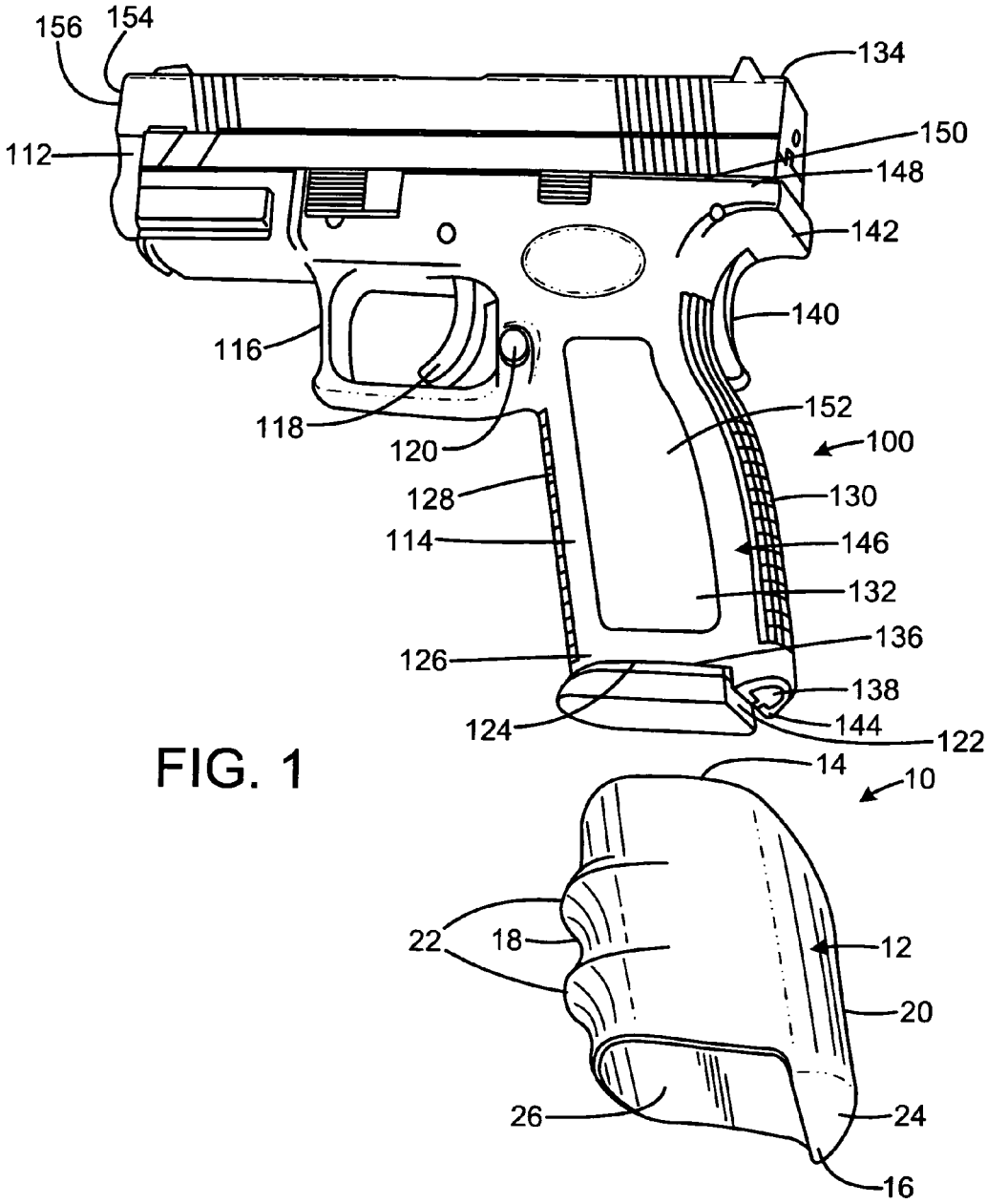
FIG. 1 is an exploded perspective view of a first embodiment of the firearm grip sleeve with retention feature constructed in accordance with the principles of the present invention for use with a pistol having a nonremovable back strap.

A first embodiment of the firearm grip sleeve with retention feature of the present invention is shown and generally designated by the reference numeral 10. A second embodiment of the firearm grip sleeve with retention feature of the present invention is shown and generally designated by the reference numeral 200.

FIG. 1 illustrates the improved firearm grip sleeve with retention feature 10 of the present invention for use with a pistol having a nonremovable back strap 100. Such pistols typically have a unitary molded plastic grip with a curved exterior to be comfortably received in a user's hand. More particularly, the pistol 100 has a one-piece integrally molded plastic frame 146 that includes an upper edge 148 immediately below the lower edge 150 of a slide 112. The slide reciprocates with respect to the pistol during chambering of cartridges and ejection of casings. The slide includes a barrel 154 having a muzzle 156. Note that the sleeve 10 may be employed on any type of pistol or firearm in addition to those with integrally-molded frames, including any firearm having the conventional configuration of a pistol grip with a nonremovable back strap. It may also be used for a pistol with a removable back strap, with the back strap installed. It may also be used for a pistol with removable side panels or front strap. Conventional, side panel grips could be removed and replaced with this invention retained solely by means of a full circumference sleeve and corresponding locating inserts.

The frame has a downwardly-extending handgrip 114 that angles slightly rearward and is a tubular body defining an elongated well 124 capable of closely receiving a removable magazine 122. The handgrip has a lower free end 126. The grip has flat or gently curved side portions 152, a straight semi-cylindrical front strap 128 facing forward, and a curved back strap 130 facing rearward. The grip generally has an oblong, oval or "racetrack" cross-section. At the upper end of the front strap, a trigger guard 116 projects forward and upward to protect the trigger 118 from accidental activation. A magazine release 120 protrudes transversely from the frame in front of the handgrip. The back strap extends nearly to the upper edge 148 of the frame, curving rearward at its upper portion. A beavertail protrusion portion 142 of the frame protrudes rearward at the upper end of the back strap.

The pistol 100 includes a grip safety 140, which is a lever located on the rear of the grip immediately below the beavertail. The grip safety will not allow the pistol to fire unless the lever is depressed. The grip safety must be actuated by the web between thumb and forefinger of the operator's hand, as a natural consequence of holding the firearm in a firing position, in order for the firearm to fire. It is usually similar to a manual safety in its function, but it is momentary. The safety is deactivated only while the shooter maintains his or her hold on the grip, and it is reactivated immediately once the shooter releases it. It is important for safety that a firearm grip assembly that is added to the handgrip not creep upwards and actuate the grip safety.

The grip safety lever 140 protrudes through the upper portion of a rear bore 138 in the rear of the grip. The lower portion of the rear bore creates an aperture in the heel 144 at the bottom 136 rear of the grip.

The sleeve 10 of the present invention includes a body 12 with a central bore 26. The bore completely opens the top 14 of the body, while a heel cover 24 at the bottom 16 of the body narrows the bore. A plurality of ridges 22 extends from the front 18 of the body. The ridges define a plurality of grooves between the ridges that receive the user's fingers when the pistol is held in a firing position.

Figure 2:
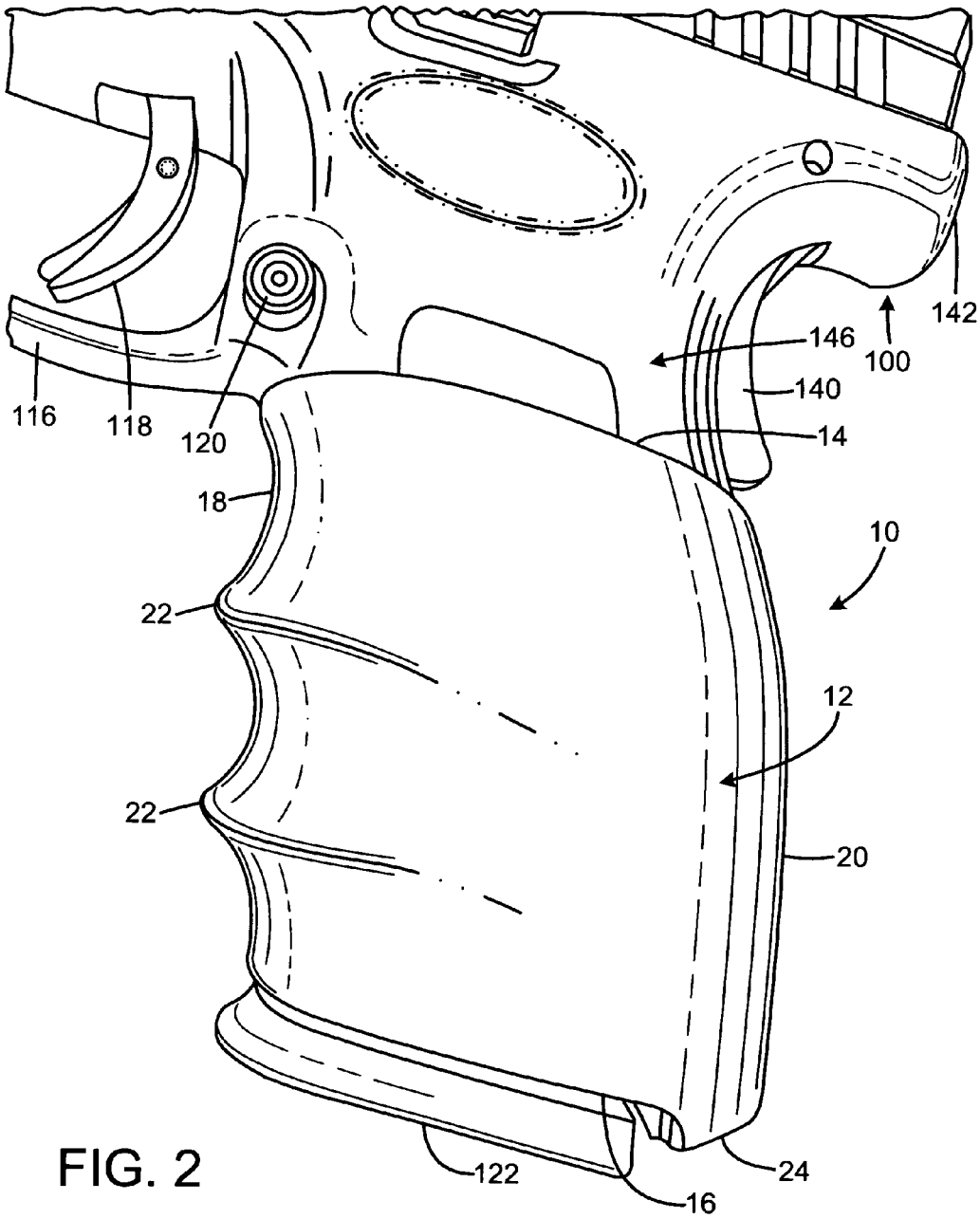
FIG. 2 is a side view of the first embodiment of the present invention installed on a pistol having a nonremovable back strap.

FIG. 2 illustrates the improved firearm grip sleeve with retention feature 10 of the present invention installed on a pistol having a nonremovable back strap 100. More particularly, the body and bore of the sleeve 10 have a generally oblong or "racetrack" cross-section so that the bore can closely receive the handgrip of the pistol 100. The heel cover 24 is shaped to closely fit over the heel of the pistol, while the bottom of the bore is shaped to avoid obstructing the pistol's magazine well. By covering the rear bore 138 in the heel, the heel cover prevents dirt and debris from entering and potentially interfering with the operation of the grip safety.

Figure 3:
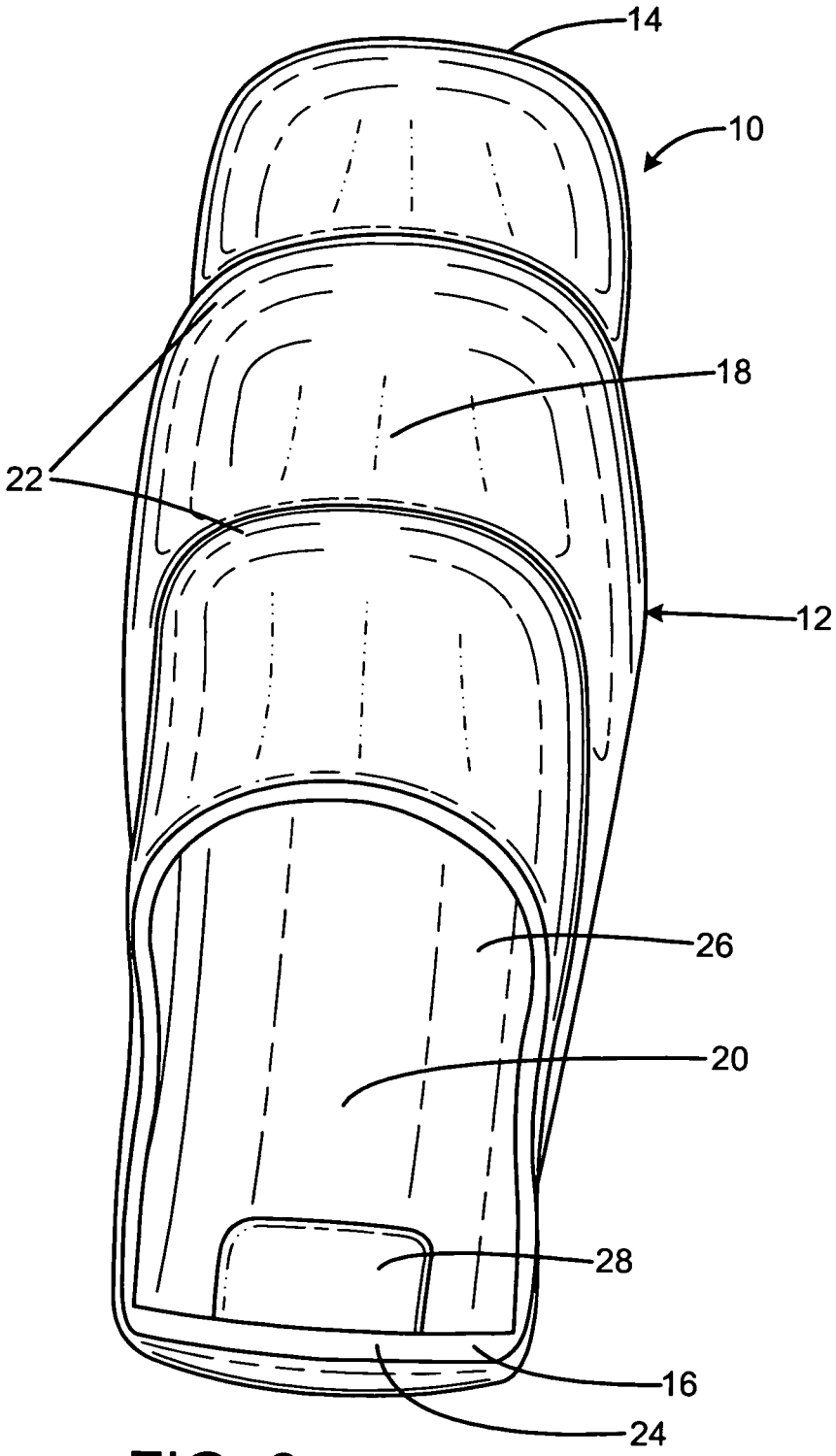
FIG. 3 is a bottom perspective view of the first embodiment of the present invention.
Figure 4:
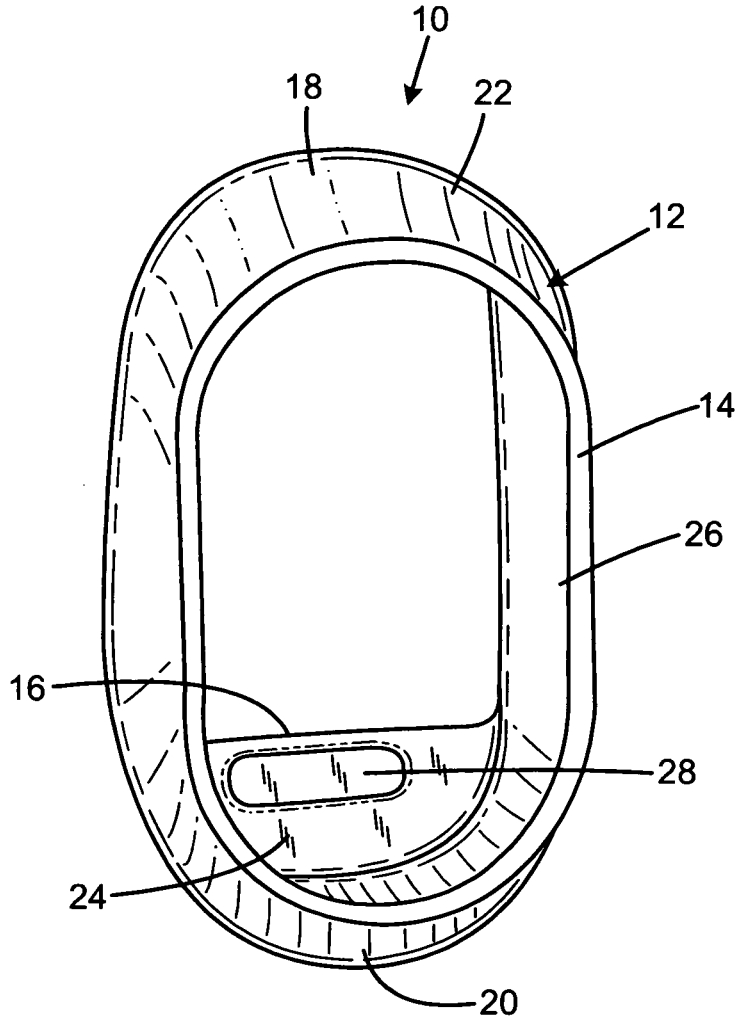
FIG. 4 is a top view of the first embodiment of the present invention.
Figure 5:
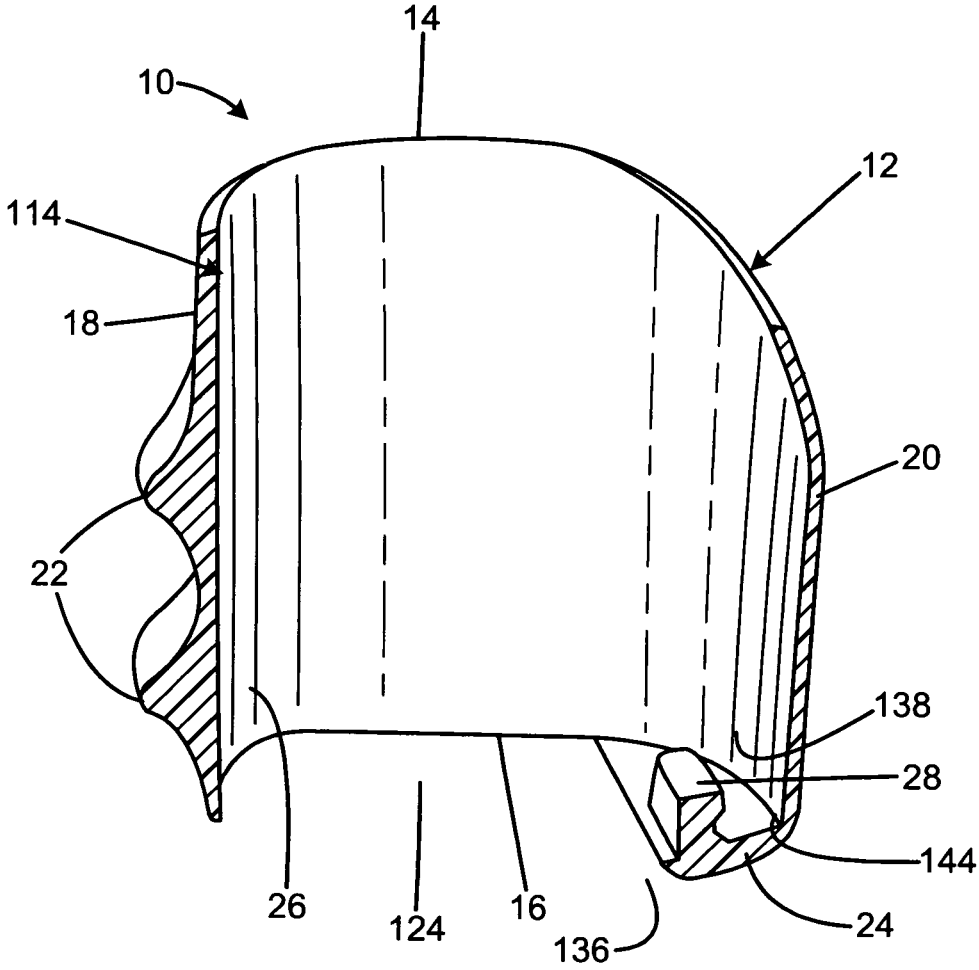
FIG. 5 is a side sectional view of the first embodiment of the present invention.

FIGS. 3-5 illustrate the improved firearm grip sleeve with retention feature 10 of the present invention. More particularly, the retention feature of the sleeve 10 is visible. The heel cover includes a retention tab 28 that protrudes upwards into the bore 26 of the body 12. The retention tab is positioned on the heel cover and formed so that the retention tab is closely received by the rear bore 138 in the heel of the pistol 100 when the sleeve 10 is installed.

The heel cover is a retention feature that positively locates the sleeve 10 on the pistol's handgrip both axially and longitudinally. Further upward movement of the sleeve 10 beyond the point where the heel cover contacts the bottom of the heel is prevented by the heel cover's engagement with the bottom of the heel. Rotational movement of the sleeve 10 is prevented by the heel cover's engagement with the sides of the heel and the retention tab's engagement with the rear bore in the heel.

In the current embodiment, the sleeve 10 is a unitary molded piece of a single material, which in the current embodiment is this thermoplastic elastomer. However, the material may be any elastomeric material preferably having a minimum durometer hardness of 30 A in order to provide adequate firmness to retain shape and resist dislocation, and preferably having a hardness of no more than 80 A so the material maintains sufficient elasticity to facilitate installation and removal. However, the retention tab could also be made from a hard plastic insert molded into the rubber sleeve.

In use, the sleeve 10 is installed on the standard factory-supplied handgrip of a pistol with a nonremovable back strap 100. To attach the sleeve 10, the free end of the handgrip is inserted into the bore 26 through the top of the sleeve 10. The sleeve is slid upwards until the pistol's heel rests in the heel cover with the retention tab inserted into the rear bore 138 in the heel. In this location, the sleeve cannot creep further upwards longitudinally or rotate axially around the handgrip. However, the sleeve can be slid downwards to remove it from the handgrip. The strict upward motion limit on the sleeve means the grip safety cannot be defeated by the sleeve. Therefore, less clearance is needed between the sleeve and the grip safety, providing better comfort for the user's hand than a sleeve requiring greater clearance.

Figure 6:
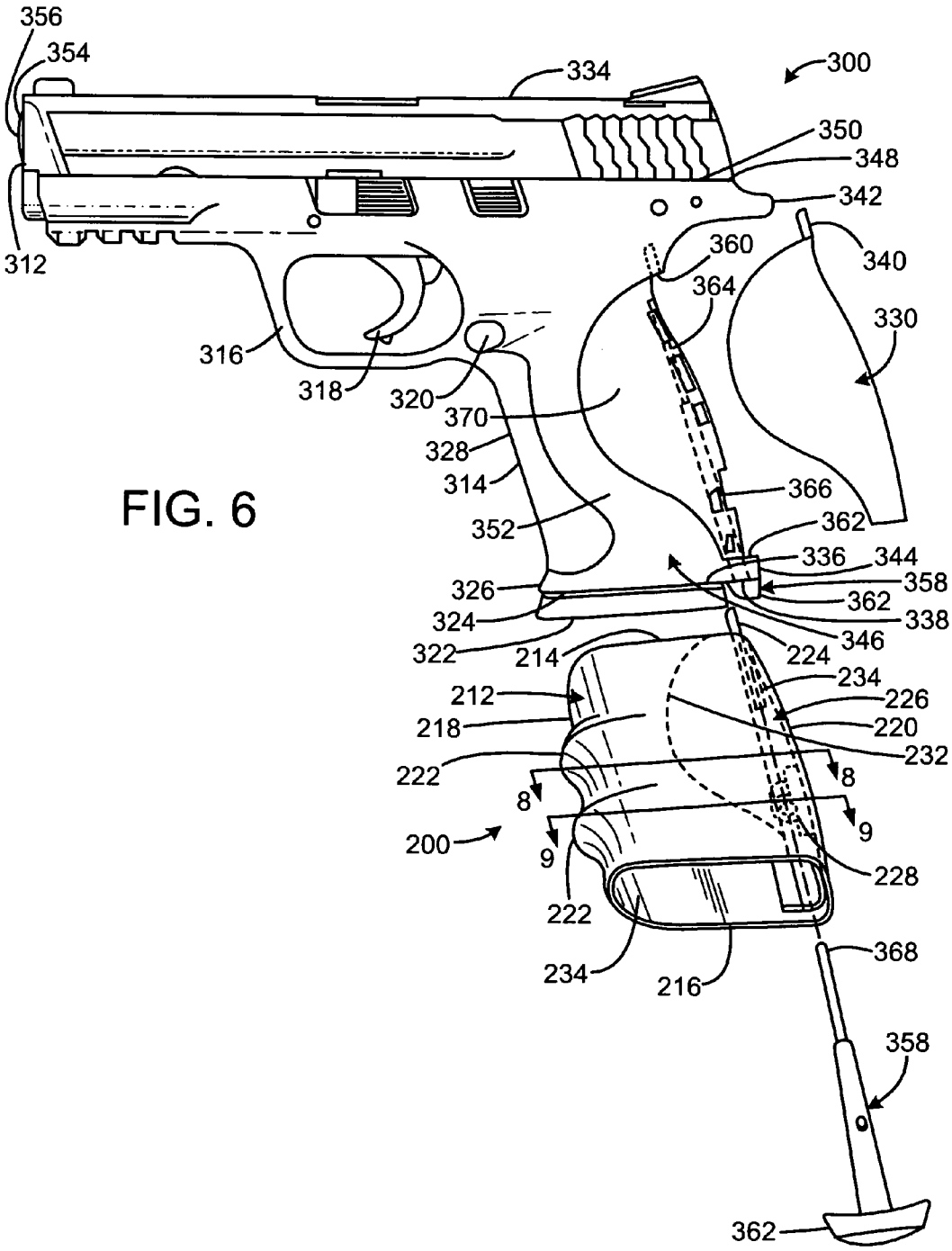
FIG. 6 is an exploded perspective view of a second embodiment of the firearm grip sleeve with retention feature constructed in accordance with the principles of the present invention for use with a pistol having a removable back strap.

FIG. 6 illustrates the improved firearm grip sleeve with retention feature 200 of the present invention for use with a pistol having a removable back strap 300. This type of pistol typically has a molded plastic grip with a curved exterior to be comfortably received in a user's hand. The pistol includes a removable back strap insert. The pistol is illustrated with its back strap insert 330 and retention pin 358 removed. More particularly, the pistol 300 has a one-piece integrally molded plastic frame 346 that includes an upper edge 348 immediately below the lower edge 350 of a slide 312. The slide reciprocates with respect to the pistol during chambering of cartridges and ejection of casings. The slide includes a barrel 354 having a muzzle 356. Note that the sleeve 200 may be employed on any type of pistol or firearm in addition to those with integrally-molded frames, including any firearm having the conventional configuration of a pistol grip with a removable back strap insert.

The frame has a downwardly-extending handgrip 314 that angles slightly rearward and is a tubular body defining an elongated well 324 capable of closely receiving a removable magazine 322. The handgrip has a lower free end 326. The grip has flat or gently curved side portions 352, a straight semi-cylindrical front strap 328 facing forward, and a curved back strap recess 370 facing rearward. The grip generally has an oblong, oval or "racetrack" cross-section. At the upper end of the front strap, a trigger guard 316 projects forward and upward to protect the trigger 318 from accidental activation. A magazine release 320 protrudes transversely from the frame in front of the handgrip. The back strap extends nearly to the upper edge 348 of the frame, curving rearward at its upper portion. A beavertail protrusion portion 342 of the frame protrudes rearward at the upper end of the back strap recess.

The pistol 300 includes a back strap insert 330, which is a curved insert that is normally located on the rear of the grip immediately below the beavertail. With the back strap installed as shown, the grip has a curved and continuous surface to provide a secure comfortable grip, in the manner of any pistol. With the backstrap removed, the grip has discontinuities, steps, cavities, and other features that render it unsuitable for use. The back strap insert is received by the back strap recess and has mating features that engage with mating features on the grip. Specifically, the grip defines a tab slot 360 immediately below the beavertail that receives a retention tab 340 protruding upward from the back strap insert. The grip also defines a retention sleeve aperture 366 located above the heel. The retention sleeve aperture receives a retention sleeve with a bore (not shown) that protrudes forward from the rear interior of the back strap insert.

The upper portion of the grip 314 defines a pin channel 364 in the rear of the grip. A rear bore 338 that is axially registered with the pin channel creates an aperture in the heel 344 at the bottom 336 rear of the grip. A retention pin 358 is used to releasably secure the back strap insert to the rear of the grip. The tip 368 of the retention pin is inserted through the rear bore, the bore in the back strap insert's retention sleeve, and into the pin channel. When the retention pin is installed, its head 362 covers the rear bore 338.

The sleeve 200 of the present invention includes a body 212 with a central bore 234. The bore completely opens the top 214 and bottom 216 of the body. A plurality of ridges 222 extends from the front 218 of the body. The ridges define a plurality of grooves between the ridges that receive the user's fingers when the pistol is held in a firing position.

The rear 220 of the body includes a rigid insert 226. The top 214 of the insert terminates in a retention tab 224. The insert also includes a retention sleeve 228. The retention sleeve protrudes forward from the rear interior of the insert.

Figure 7:
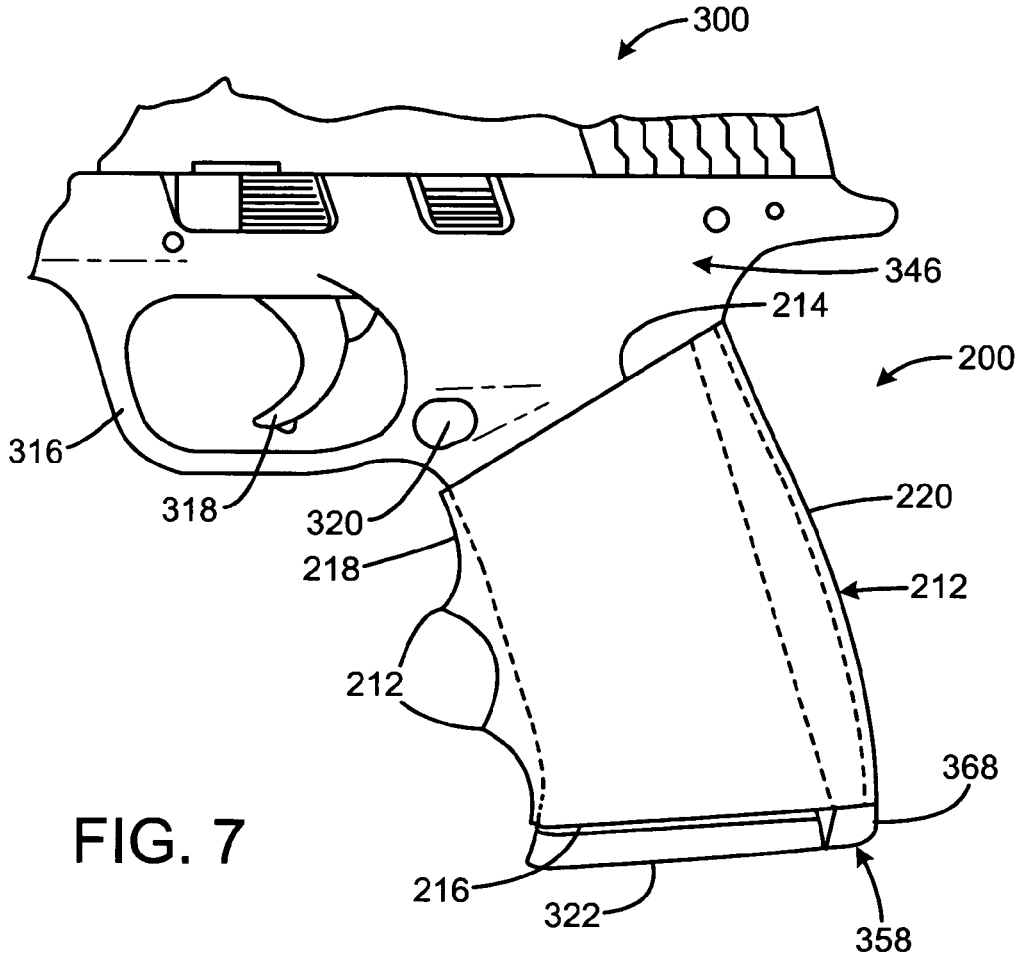
FIG. 7 is a side view of the second embodiment of the present invention installed on a pistol having a removable back strap.
Figure 8:
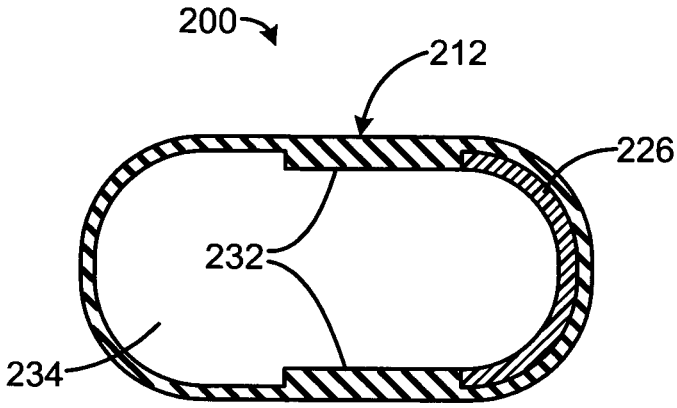
FIG. 8 is a top sectional view of the second embodiment of the present invention taken along the line 8-8 of FIG. 6.
Figure 9:
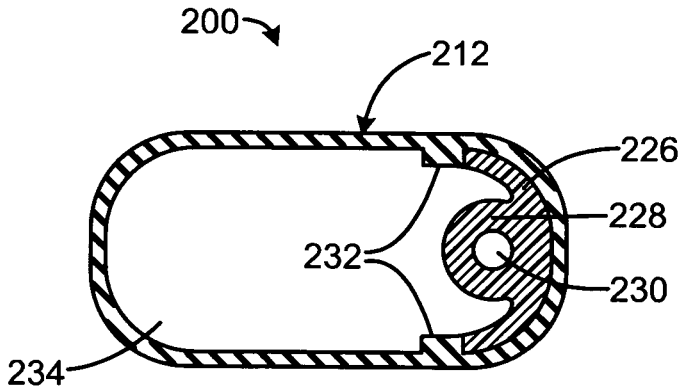
FIG. 9 is a top sectional view of the second embodiment of the present invention taken along the line 9-9 of FIG. 6.
Figure 10:
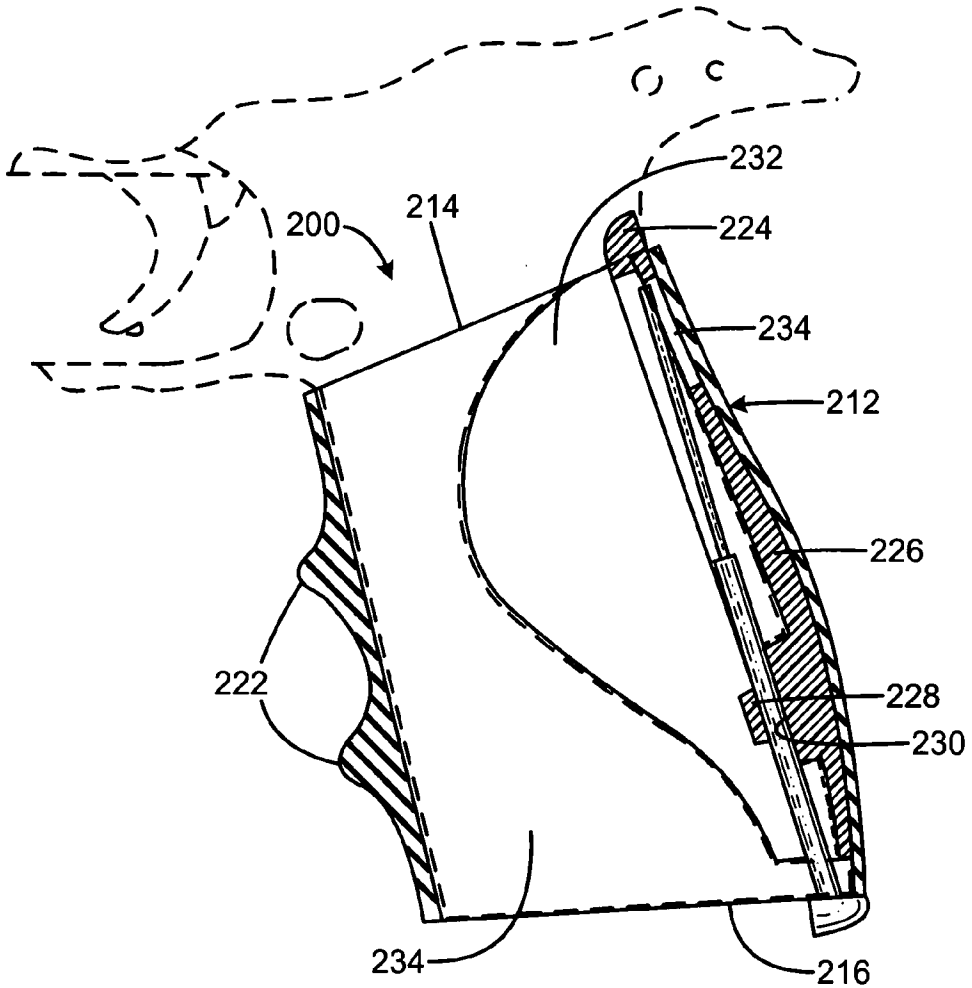
FIG. 10 is a side sectional view of the second embodiment of the present invention installed on a pistol having a removable back strap.
Figure 11:
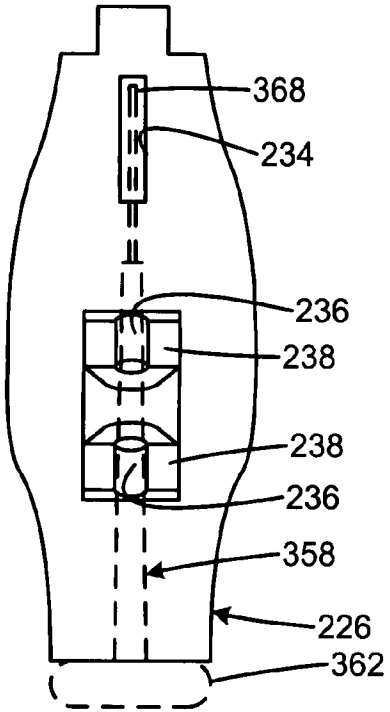
FIG. 11 is a front view of the insert of the second embodiment of the present invention.

FIG. 7 illustrates the improved firearm grip sleeve with retention feature 200 of the present invention installed on a pistol having a removable back strap 300. More particularly, the body and bore of the sleeve 200 have a generally oblong or "racetrack" cross-section so that the bore can closely receive the handgrip of the pistol 300. The bottom of the bore is shaped to avoid obstructing the pistol's magazine well and the head of the retention pin.

FIGS. 8-11 illustrate the improved firearm grip sleeve with retention feature 200 and the insert 226 of the present invention. More particularly, the retention features of the sleeve 200 are visible. The top of the insert in the rear of the body includes a retention tab 224 that protrudes upwards. The retention tab is positioned on the insert and formed to be closely received by the pistol's tab slot 360 when the sleeve 200 is installed.

There is also a retention sleeve 228 that protrudes forward from the rear of the insert. The retention sleeve is formed to be closely received by the pistol's retention sleeve aperture 366. The retention sleeve is positioned on the insert and formed so that the retention sleeve is closely received by the pistol's retention sleeve aperture 366 when the sleeve 200 is installed. The retention sleeve defines a bore 230. The bore 230 is axially registered with the pistol's rear bore 338 and pin channel 364. This enables the bore 230 to receive the retention pin 358 when the pin is installed in the rear bore and pin channel.

Two pin rests 238 are present on the rear of the insert, one immediately above and one immediately below the retention sleeve 228. Each pin rest defines a pin recess 236 that is formed to receive the retention pin. The pin recesses are axially registered with the bore 230 in the retention sleeve.

The insert also defines a pin groove 234 that is located below the retention tab 224 in the top rear of the insert. The pin groove is axially registered with the bore 230 in the retention sleeve 228. This enables the pin groove to closely receive the tip 368 of the retention pin when the retention pin is installed in the rear bore and pin channel.

The body also includes back strap tongues 232 that extend into the bore 234 beginning at the forward edge of the insert 226. The back strap tongues are shaped to be closely received by the back strap recess 370 on the grip.

The retention tab and retention sleeve are retention features that positively locate the sleeve 200 on the pistol's handgrip both axially and longitudinally. Further upward movement of the sleeve 200 is prevented by the retention tab's engagement with the tab slot and the retention sleeve's engagement with the retention sleeve aperture. Rotational movement of the sleeve 200 is prevented by the retention tab's engagement with the tab slot, the retention sleeve's engagement with the retention sleeve aperture, the retention sleeve's engagement with the retention pin, and the back strap tongues' engagement with the back strap recess. Downward movement is prevented by the engagement of the bottom edge of the insert with a ledge 362 formed by the top of the heel 344 and contact between the top edge of the pin groove in the insert with the tip of the retention pin.

In the current embodiment, the sleeve 200 is a unitary molded piece comprising two materials. The body is made of thermoplastic elastomer in the current embodiment. However, the body may be any elastomeric material preferably having a minimum durometer hardness of 30 A in order to provide adequate firmness to retain shape and resist dislocation, and preferably having a hardness of no more than 80 A so the material maintains sufficient elasticity to facilitate installation and removal. The insert is a rigid material, which is a hard plastic element molded into the rubber sleeve in the current embodiment. It is desirable for the two materials to form a chemical bond between them. Such a molding process is described in U.S. Pat. No. 6,301,817 (Hogue et al.).

In use, the sleeve 200 is installed on the standard factory-supplied handgrip of a pistol with a removable back strap 300. To attach the sleeve 200, the back strap is first removed from the pistol 300 by twisting the factory retention pin one quarter turn and removing the retention pin to release the back strap insert. Subsequently, the free end of the handgrip is inserted into the bore 226 through the top of the sleeve 200. The sleeve is slid upwards until the insert's retention tab is fully inserted into the tab slot in the top rear of the grip, the retention sleeve is fully inserted into the retention sleeve aperture in the bottom rear of the grip, the back strap tongues are fitted into the back strap recess, and the bottom edge of the insert rests on the ledge formed by the pistol's heel. Then, the tip 368 of the retention pin is inserted through the rear bore, the bore in the insert's retention sleeve, and the pin channel until the head of the pin is flush with the pistol's heel and the tip of the pin is received by the pin groove in the top of the insert. Finally, the retention pin is twisted one quarter turn to releasably secure the pin to the pistol's frame.

Although the sleeve 200 is designed to permit the retention pin to be reinstalled in the firearm's grip, the sleeve is nonetheless securely mounted on the grip even with the retention pin removed. The sleeve's resiliency secures it to the grip, along with the interaction of the sleeve's retention features with the mating features on the grip.

In the context of the specification, the terms "rear" and "rearward," "front" and "forward," "longitudinal," "transverse," "axial" and "axially," and "undesirable movement" have the following definitions: "rear" or "rearward" means in the direction away from the muzzle of the firearm while "front" or "forward" means it is in the direction towards the muzzle of the firearm; "longitudinal" means in the direction of or in parallel with the longitudinal axis of the handgrip while "transverse" means in a direction across the longitudinal direction; "axially" means in a direction around the longitudinal direction; and "undesirable movement" means both axial movement and upward longitudinal movement of the sleeve beyond the point at which the sleeve's retention features are first securely engaged with the firearm's frame.

By including at least one retention feature that positively locates the sleeves on the pistol's handgrip both axially and longitudinally, the sleeves of the current invention can be made to fit less tightly than prior art firearm grip sleeves, enabling them to be installed and uninstalled more easily. Furthermore, the sleeves can also use a thinner material than prior art firearm grip assemblies because the sleeves do not rely on the thickness and stiffness of the material to secure them in place. Using a thinner material reduces the amount of added girth, making the sleeves more comfortable for users with smaller hands than known firearm grip assemblies.

The firearm grip sleeves with retention feature thus described enable enhancement of the functionality of standard factory-supplied firearm grips while remaining in a fixed position with respect to the firearm grip. Although a retention feature that protrudes under and around the sides of the trigger guard could also conceivably positively locate the sleeves both axially and longitudinally with respect to the handgrip, the addition of material under and around the trigger guard could potentially create problems by placing the shooter's hand in an atypical position with respect to the trigger.

While current embodiments of firearm grip sleeves with retention features have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, while pistols as described are the most likely contemplated application for the concepts of the present invention, it should be appreciated that the current invention could be used with any firearm grip, including revolvers and rifles such as AR-15s, as well as hand and power tools and other implements with a handgrip.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A removable elastomeric firearm grip sleeve and firearm combination comprising:

a body;

the body including a central bore;

the body including a mating element;

a firearm having a frame with a mating feature, wherein the mating element is received by the mating feature;

the mating element preventing undesirable movement of the body with respect to the firearm's frame while the mating element is received by the mating feature; and wherein the mating element includes a protrusion extending from the body into the central bore of the body.

2. The sleeve of claim 1 wherein undesirable movement of the body is movement selected from the group comprising axial movement and upward longitudinal movement.

3. The sleeve of claim 1 wherein the central bore of the body forms an interior that conforms to a portion of the frame.

4. The sleeve of claim 1 wherein the mating feature is an aperture in the frame.

5. The sleeve of claim 1 wherein the mating feature is a portion of the frame, and the mating element is a pocket defined by the body that closely receives the mating feature.

6. The sleeve of claim 5 wherein the mating feature is a rear bore in a handgrip heel.

7. The sleeve of claim 1 wherein the mating element includes a surface located at one end of the body that is substantially perpendicular to the central bore.

8. The sleeve of claim 7 wherein the surface is located at a lower edge of the body.

9. The sleeve of claim 7 wherein the mating element includes the protrusion extending from the surface into the central bore of the body.

10. The sleeve of claim 1 wherein the protrusion extending from the body into the central bore of the body extends forward from a rear interior surface of the body.

11. The sleeve of claim 1 wherein the protrusion extending from the body into the central bore of the body defines a bore.

12. The sleeve of claim 11 wherein the mating feature includes an aperture in the frame and an elongate pin that is received by the aperture in the frame and the bore in the protrusion extending from the body into the central bore of the body, and wherein the aperture in the frame receives the protrusion extending from the body into the central bore of the body.

13. The sleeve of claim 1 wherein the body is a unitary molded piece of a single elastomeric material.

14. The sleeve of claim 1 wherein the body is a unitary molded piece comprising a resilient material and a rigid material.

15. The sleeve of claim 14 wherein a chemical bond is formed between the resilient material and the rigid material.

16. The sleeve of claim 1 wherein the firearm includes a removable back strap insert.

17. The sleeve of claim 1 wherein the sleeve is entirely formed of an elastomeric material.

18. The sleeve of claim 1 wherein the sleeve has a continuous uninterrupted tubular form that encompasses the grip.

19. The sleeve of claim 1 wherein the mating element is formed of an elastomeric material.

20. A removable elastomeric firearm grip sleeve and firearm combination comprising:

a body;

the body including a central bore;

the body including a mating element;

a firearm having a frame with a mating feature, wherein the mating element is received by the mating feature;

the mating element preventing undesirable movement of the body with respect to the firearm's frame while the mating element is received by the mating feature; and wherein the mating element includes a protrusion extending upwards from a top-facing surface at the bottom of the body.

21. A removable elastomeric firearm grip sleeve and firearm combination comprising:

a body;

the body including a central bore;

the body including a mating element;

a firearm having a frame with a mating feature, wherein the mating element is received by the mating feature;

the mating element preventing undesirable movement of the body with respect to the firearm's frame while the mating element is received by the mating feature; and wherein the mating feature of the frame is a passage extending upward from the lower end of the frame, and the mating element is a protrusion extending into the passage.

* * * * *